US005295470A

United States Patent [19]

Straubel

[11] Patent Number: 5,295,470

[45] Date of Patent: Mar. 22, 1994

[54] FUEL INJECTION APPARATUS FOR INTERNAL COMBUSTION ENGINES

[75] Inventor: Max Straubel, Stuttgart, Fed. Rep. of Germany

[73] Assignee: Robert Bosch GmbH, Stuttgart, Fed. Rep. of Germany

[21] Appl. No.: 31,305

[22] Filed: Mar. 12, 1993

[30] Foreign Application Priority Data

Apr. 7, 1992 [DE] Fed. Rep. of Germany ..... 4211651

[51] Int. Cl.[5] ..... F02M 41/00

[52] U.S. Cl. ..... 123/458; 123/198 DB; 123/467; 123/500

[58] Field of Search ..... 123/500, 501, 447, 198 D, 123/198 DB, 458, 514, 467, 506

[56] References Cited

U.S. PATENT DOCUMENTS

| | | | |
|---|---|---|---|
| 4,273,090 | 6/1981 | Hofer | 123/506 |
| 4,395,987 | 8/1983 | Kobayashi | 123/458 |
| 4,426,969 | 1/1984 | Eheim | 123/458 |
| 4,589,393 | 5/1986 | Jourde | 123/148 DB |
| 4,712,528 | 12/1987 | Schaffitz | 123/447 |
| 4,718,384 | 1/1988 | Takahashi | 123/506 |
| 4,807,583 | 2/1989 | Thornwaite | 123/198 DB |
| 4,811,710 | 3/1989 | Schmitt | 123/198 DB |
| 4,903,666 | 2/1990 | Buisson | 123/506 |
| 4,982,713 | 1/1991 | Buisson | 123/467 |
| 5,005,548 | 4/1991 | Rembold | 123/447 |
| 5,102,047 | 4/1992 | Rossignol . | |

*Primary Examiner*—Carl S. Miller

*Attorney, Agent, or Firm*—Edwin E. Greigg; Ronald E. Greigg

[57] ABSTRACT

A fuel injection apparatus for internal combustion engines, which includes a pump piston guided in a cylinder bore driven to reciprocate axially by a cam drive. With a face end, the pump piston defines a pump work chamber, which communicates with an injection valve via a pressure conduit and which is supplied with fuel and relieved via a fuel line. Supply onset and supply end are controllable via a feed pump and a magnet valve are disposed in the fuel line, which communicates with a fuel supply vessel (33) to control supply onset and end of supply. In order to relieve a pressure of the high-pressure chambers, especially at high engine speeds, a fuel tapping device, which is controllable as a function of pressure is connected to a relief line that branches off from the fuel line.

19 Claims, 2 Drawing Sheets

FIG. 2
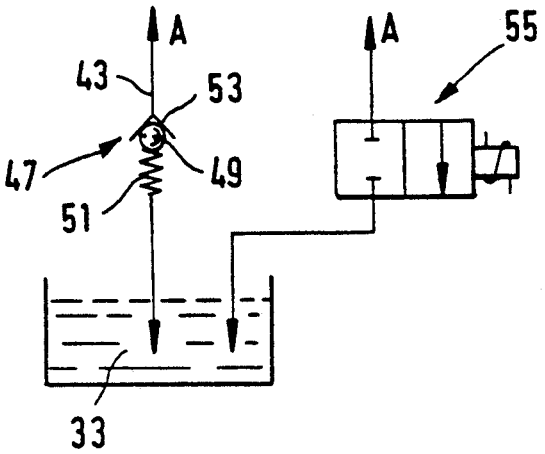
FIG. 3
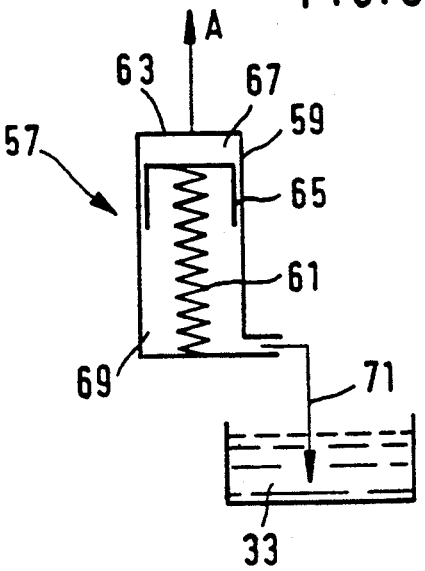
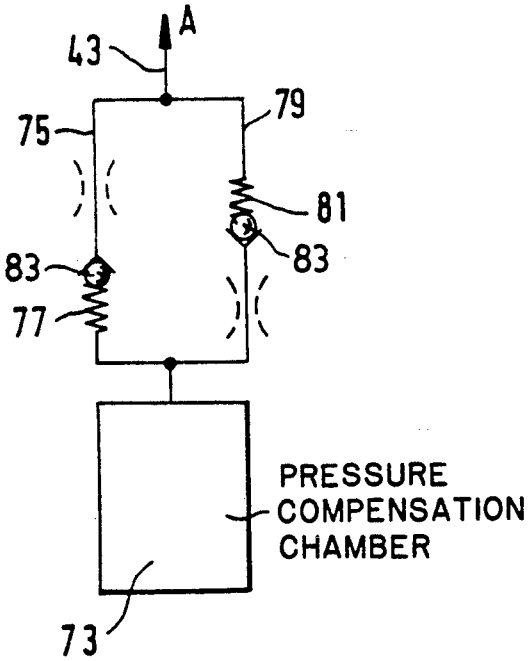
FIG. 4
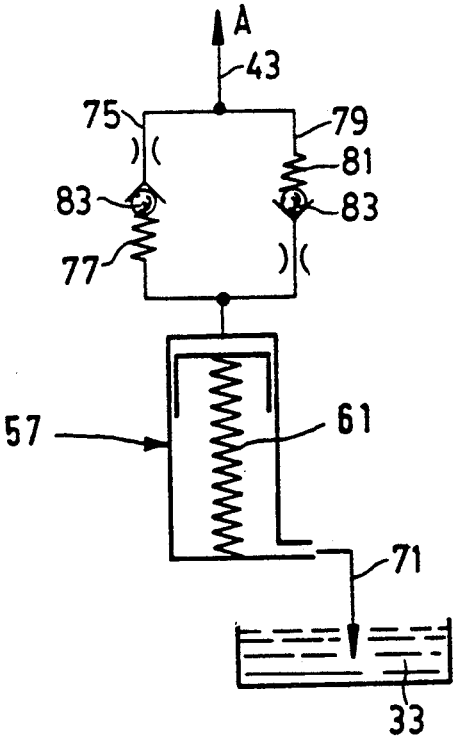
FIG. 5

FUEL INJECTION APPARATUS FOR INTERNAL COMBUSTION ENGINES

BACKGROUND OF THE INVENTION

The invention is based on a fuel injection apparatus for internal combustion engines as defined hereinafter. In a fuel injection apparatus of this kind, known from an earlier German patent application number P 39 434 192 (U.S. Pat. No. 5,102,047), a pump piston axially guided in a cylinder bore of a pump housing is driven to reciprocate by a cam drive. With its face end remote from the cam drive the pump piston defines a pump work chamber in the cylinder bore into which a fuel supply line discharges and which is connected via a pressure conduit to an injection valve protruding into the combustion chamber of the internal combustion engine to be supplied. Both the quantity of fuel to be injected and also the beginning of the high-pressure delivery of the fuel found in the pump work chamber and therefore the beginning of the injection are regulated via the diversion process by means of a magnet valve that opens on either end, which is disposed in the fuel feed line, and which is controlled as a function of the operating parameters of the engine to be supplied.

Since the known unit fuel injector is driven mechanically via the cam drive as a function of the speed of the engine to be supplied, it has the disadvantage of a very steep increase of the injection pressure in the pump work chamber as the speed of the engine increases. The result, in a unit fuel injector design with an admissible maximum pressure at the nominal capacity point of the engine, or in other words at high engine speeds, is that the injection pressure in the lower speed range is not high enough. For an optimal combustion and the attendant low level of pollutant emissions, however, high injection pressures in the lower speed range are already necessary, which cannot be attained with the known unit fuel injector.

OBJECT AND SUMMARY OF THE INVENTION

The fuel injection apparatus for internal combustion engines has an advantage over the prior art that the pressure at high engine speeds can be limited by means of a withdrawal of fuel and the unit fuel injector can be so designed with reference to its delivery rate that high injection pressures at lower engine speeds can already be attained. It is therefore already possible at low speeds and low load to attain high injection pressures without exceeding the maximum allowable pressure value in the high-pressure part of the unit fuel injector, especially in the pump work chamber in the nominal capacity range of the engine.

For this purpose, an intervention into the regulation loop between the pump work chamber and the magnet valve is advantageously made via a tapping device that communicates with the high-pressure side.

This tapping device can be embodied as a check valve in the form of a pressure limiting valve; the opening pressure at a given time of each pressure limiting valve can be adapted to the operating conditions of the engine to be supplied, via the initial tension of the valve spring.

The tapping device is advantageously embodied as a magnet valve, which can be opened as a function of the speed of the engine.

In order to avoid an additional energy loss caused by the return flow of the diverted fuel in the fuel circuit of the engine, the tapping device is advantageously embodied as a spring reservoir, which is embodied by a piston guided in a cylinder and acted upon by a spring, which piston, as a result of the outflowing fuel, opens up a relief volume which will be discharged again into the pump work chamber during its filling process during the intake stroke of the pump piston.

The chamber which receives the outflowing fuel quantity during the withdrawal process can also be furnished advantageously by a space embodied by means of a vessel whose dimensions can be determined by means of the pressure and quantity conditions of the outflowing fuel. The vessel communicates with the fuel supply line via two pressure lines running parallel to each other, a check valve that opens toward the vessel is disposed in one line and a check valve that opens in the opposite direction is disposed in the other line opens in the opposite direction. The opening pressure of these check valves determines the pressure level at which the pressure limiting is intended to function. Each of the check valves is preceded upstream by a throttle, to control the high speed flow processes. By means of the arrangement of the outflow device described herein, it is consequently possible to regulate the outlet pressure level in the relief chamber and to supply the diverted fuel back to the pump work chamber without additional renewed feed pump work.

The invention will be better understood and further objects and advantages thereof will become more apparent from the ensuing detailed description of preferred embodiments taken in conjunction with the drawings.

BRIEF DESCRIPTION OF THE DRAWINGS

FIG. 2 shows a first exemplary embodiment of the tapping device in the form of a check valve or alternatively in the form of a controllable magnet valve;

FIG. 3 shows a further exemplary embodiment in which the tapping device is embodied as a spring reservoir;

FIG. 4 shows a third exemplary embodiment of the tapping device in which it comprises a relief vessel which communicates with the fuel line via two parallel pressure lines in which pressure valves working counter to each other are disposed; and FIG. 5 shows a fourth exemplary embodiment in which an additional spring reservoir is substituted for the relief vessel of FIG. 4.

DESCRIPTION OF THE PREFERRED EMBODIMENTS

Figure 1:
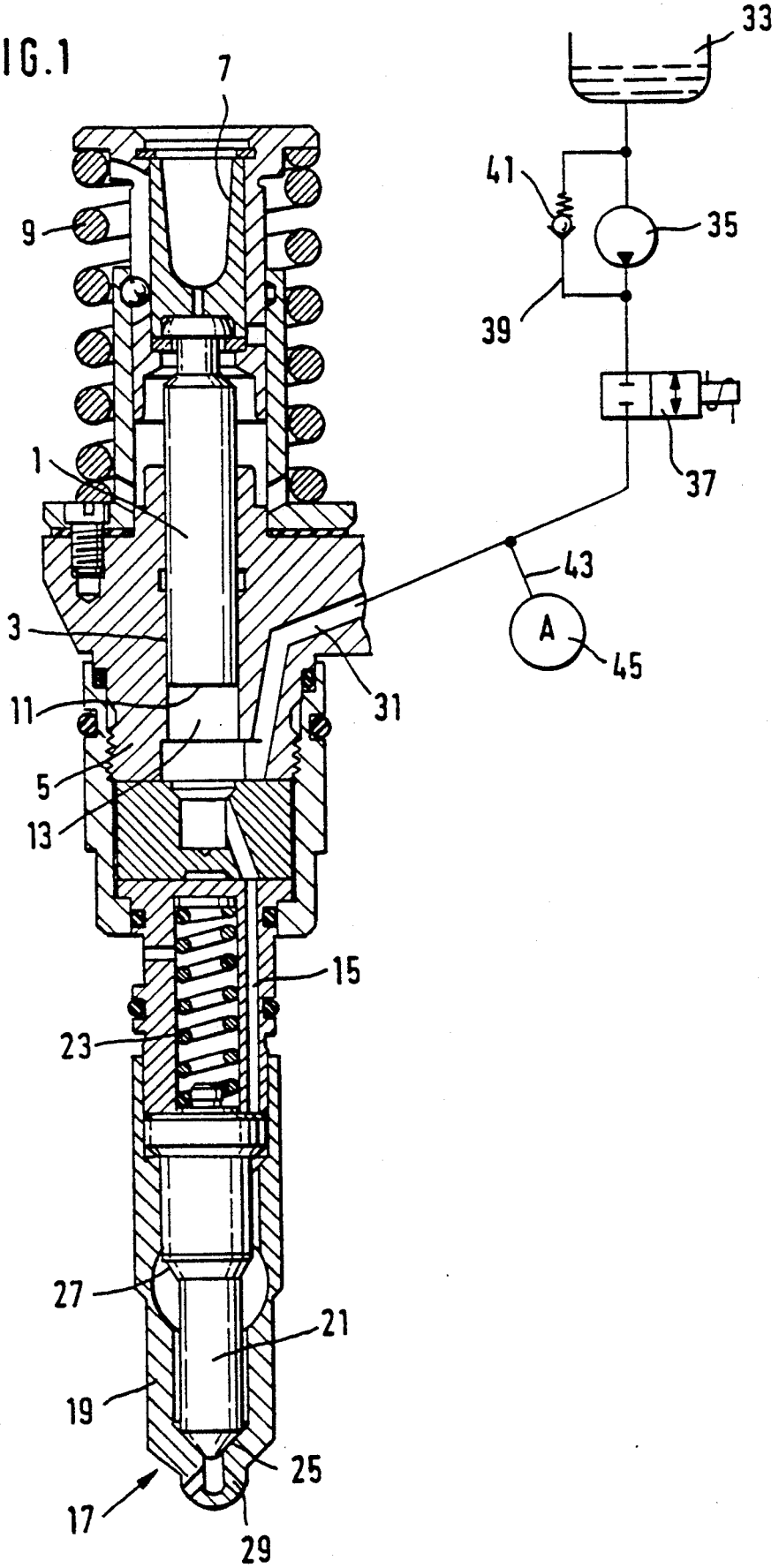
FIG. 1 is a longitudinal section through a part of a known unit fuel injector with schematic representation of the connecting points of the adjacent structural members important to the function and of the connecting point of the tapping device according to the invention.

In the unit fuel injector shown in FIG. 1, of which only the regions essential to the invention are described, a pump piston 1 is axially guided in a cylinder bore 3 of a pump housing 5 and is driven axially inward contrary to a restoring spring 9 by a cam drive 7 not shown in detail. With its face end 11 remote from the cam drive 7, the pump piston 1 defines a pump work chamber 13 in the cylinder bore 3, leading out of the work chamber is a pressure conduit 15 that connects the pump work chamber 13 to an injection valve 17, which comprises a valve body 19 and a valve needle 21 that is axially movable in the valve body, the valve needle being held against a stop 25 by a valve spring 23; via this stop o valve seat 25, the pressure conduit 15 is sealingly closed off from the combustion chamber of the engine to be supplied into which the injection valve 17 protrudes. The valve needle 21 of the injection valve 17 has a shoulder 27 which the fuel engages as it flows out of the pump work chamber 13 under high pressure, causing the valve needle 21 to lift from its seat 25 counter to the restoring force of the valve spring 23, so that the fuel from the pump work chamber 13 reaches the combustion chamber via the pressure conduit 15 and two injection ports 29.

A fuel line 31 also discharges into the pump work chamber 13; it begins at a fuel supply vessel 33, and a feed pump 35 and a magnet valve 37 are disposed in the fuel line Since not only the filling, but also the supply onset and the end of injection, are controlled via the magnet valve 37 and the fuel line 31, the fuel line 31 can have a flow through it in both directions, and the fuel that flows out of the pump work chamber 13 during the diversion process flows back into the fuel supply vessel 33 via a bypass line 39. A pressure control valve 41 which opens toward the fuel supply vessel 33 is inserted in the bypass line 39 to achieve a defined supply pressure of the feed pump 35.

A branch line 43 joined by a tapping device branches off from the fuel line 31, and is provided for the purpose of limiting the pressure of the compressed fuel in the pump work chamber 13 at high engine speeds and hence of raising the overall pressure level achievable by the fuel injection pump especially in the low speed range. This tapping device 45 is shown only symbolically in FIG. 1 and is shown in more detail in further variant embodiments in FIGS. 2–5.

In the first variant embodiment shown in FIG. 2, the tapping device 45 comprises a pressure limiting valve 47 inserted in the branch line 43; it has a one-way valve closing member 49 and a valve spring 51 that presses the closing member against a valve seat 53; the opening pressure of the pressure limiting valve 47 is adjustable via the initial tension of this valve spring 51. The branch line 43 feeds into an additional fuel supply vessel 33 downstream of the pressure limiting valve 47. Analogously, FIG. 2 shows a further possible embodiment in which the pressure limiting valve 47 is embodied by means of a magnet valve 55 that opens in either direction and that is controlled as a function of the operating parameters of the engine, especially the engine speed. This magnet valve 55 opens at a defined high pump or engine speed, with a defined high fuel injection pressure in the pump work chamber 13 the magnet valve 55 makes possible the outflow of some of the highly pressurized fuel from the pump work chamber 13, through the fuel line 31, and into the fuel supply vessel 33, in order to limit the pressure in the event of a further engine speed increase.

In FIG. 3 the tapping device 45 is embodied as a spring reservoir 57 which comprises a piston 65 guided in a cylinder 59 and held against a stop 63 by a restoring spring 61. Here, too, the limit pressure, at which the tapping device responds, is defined by means of the restoring spring 61, and the piston 65 moves downward during the outflow process contrary to the force of the restoring spring 61 and thus opens up a relief volume 67 in the cylinder 59 which receives the outflowing fuel. After the high-pressure injection is terminated by means of the magnet valve 37, some of the stored fuel volume flows back into the fuel supply vessel 33 via the fuel line 31, the magnet valve 37, and the bypass line 39. If the diversion pressure of the outflowing fuel falls below the closing pressure of the pressure control valve 41 disposed in the bypass line 39, the residual fuel quantity is re-supplied from the relief volume 67 to the pump work chamber 13, via the fuel line 31, and consequently reinforces the fuel delivery by the fuel feed pump 35. The spring chamber 69 that receives the restoring spring communicates with a fuel supply vessel 33 via an overflow line 71 to effect the drainage of an overflow fuel quantity.

In the tapping device 45 shown in FIG. 4, a vessel embodying a pressure compensation chamber 73 communicates with the branch line 43 of the fuel line 31 via two pressure lines running parallel to each other. The first pressure line 75 has a first one-way pressure valve 77 that opens toward the pressure compensation chamber 73, while the second pressure line 79 has a second pressure valve 81 that opens in the opposite direction, namely toward the fuel line 31. The opening pressures of the first pressure valve 77 and of the second pressure valve 81 determine the pressure level at which the pressure limitation is intended to work. Each of the check valves 77, 81 is preceded upstream by a throttle 83 to control the high-speed flow processes. The pressure compensation chamber 73 fills with the diverted fuel quantity and stores it during the diversion process, whenever a defined allowable maximum pressure value in the pump work chamber, which can be determined via the opening pressure of the first pressure valve 77 is exceeded. After the end of high-pressure injection, therefore after the opening of the magnet valve 37, the high pressure in the fuel line 31 is relieved and the pressure falls below that in the pressure compensation chamber 73. Consequently the fuel under high pressure in the pressure compensation chamber 73 opens the second one-way pressure valve 1, and the fuel flows back into the fuel supply vessel 33 via the magnet valve 37 and the bypass line 39, or is fed once again into the pump work chamber 13 after the reversal of the magnet valve 37 in the ensuing intake stroke.

The fourth exemplary embodiment of the tapping device 45 shown in FIG. 5 differs from the one described in FIG. 4 merely in the embodiment of the pressure compensation chamber 73. Here it is embodied in the form of a spring reservoir 57 and works in the manner described in FIG. 3. The use of a spring reservoir 57 in lieu of a pressure compensation chamber 73 embodied by means of a vessel has the advantage that the relief of the pressure compensation chamber 73 is reinforced and can be influenced via the initial tension of the restoring spring 61 of the spring reservoir 57.

With the embodiments of the tapping device 45 described in FIGS. 2–5, it is consequently possible to carry out a limitation of the fuel injection pressure independent of the control by the magnet valve 37, which regulates merely the onset and end of supply; by means of this pressure limitation, high injection pressures are already achievable in the lower engine speed range, without leading to an overload on the pump elements in the upper engine speed range. To reliably adhere to the quantity tolerances of the fuel to be injected, additional means are possible, which can be embodied for example by means of a closed injection quantity control circuit for each cylinder; regulation for each individual cylinder as a function of the exhaust gas temperature or of an emissions detector is advantageous.

The above described fuel injection apparatus, in which the fuel injection quantity and the duration of injection is controlled with the aid of a magnet valve, can however also be applied to a fuel injection pump in which the fuel injection is controlled by other means, such as oblique-edge control or by means of slides displaceable on the pump pistons, as in the so-called reciprocating slide pump, for example.

The foregoing relates to preferred exemplary embodiments of the invention, it being understood that other variants and embodiments thereof are possible within the spirit and scope of the invention, the latter being defined by the appended claims.

WHAT IS CLAIMED AND DESIRED TO BE SECURED BY LETTERS PATENT OF THE UNITED STATES IS:

1. A fuel injection apparatus for internal combustion engines having a pump piston (1) guided in a cylinder bore (3) disposed in a pump housing (5) which is driven to axially reciprocate by a cam drive (7) and which with a face end (11) remote from the cam drive (7) defines a pump work chamber (13) which communicates via a pressure conduit (15) with an injection valve (17) which is supplied with fuel during an intake stroke of the pump piston (1) via a fuel line (31), a feed pump (35) which communicates with a fuel supply vessel (33) and said fuel line (31), a bypass line (39) which bypasses said feed pump, a control valve (37) in said fuel line (31) pump work chamber (13) for controlling a high-pressure fuel feed phase of the pump piston (1), a branch line (43) that branches off from said fuel line (31) on the pump work chamber side of the control valve (37), a fuel tapping device (45) disposed in said branch line (43) which opens at a fixed pressure corresponding to an upper engine speed range.

2. A fuel injection apparatus as defined by claim 1, in which that the pressure-dependent fuel tapping device (45) is embodied as a pressure limiting valve (47) whose opening pressure is defined via an initial tension of a valve spring (51).

3. A fuel injection apparatus as defined by claim 1, in which that the pressure-dependent fuel tapping device (45) is embodied as a magnet valve (55) that is electrically openable as a function of a speed of the engine.

4. A fuel injection apparatus as defined by claim 1, in which the pressure-dependent fuel tapping device (45) is embodied by means of a prestressed spring reservoir (57), which comprises a piston (65) guided in a cylinder (59), whose piston (65) is brought against a stop face (63) during a low-pressure phase by a restoring spring (61) and which includes a spring chamber (69) that encompasses the restoring spring (61) which communicates with a fuel tank via an oil overflow line (71).

5. A fuel injection apparatus as defined by claim 1, in which the fuel tapping device (45), which opens as a function of pressure, comprises a valve assembly which has a first pressure valve (77) disposed in a first pressure line (75) that opens away from a high-pressure side (13, 15, 31) and a second pressure valve (81) disposed in a second pressure line (79) parallel to the first pressure line that opens in an opposite direction, each pressure valve being preceded by a throttle restriction (83), and the pressure lines (75, 79) are connected with a pressure compensation chamber (73) at their end remote from the high-pressure side (13, 15, 31).

6. A fuel injection apparatus as defined by claim 5, in which the pressure compensation chamber (73) is embodied as a spring reservoir (57).

7. A fuel injection apparatus as defined by claim 1, in which said control valve (37) is embodied as an electrically triggered electromagnetic valve.

8. A fuel injection apparatus as defined by claim 2, in which said control valve (37) is embodied as an electrically triggered electromagnetic valve.

9. A fuel injection apparatus as defined by claim 3, in which said control valve (37) is embodied as an electrically triggered electromagnetic valve.

10. A fuel injection apparatus as defined by claim 4, in which said control valve (37) is embodied as an electrically triggered electromagnetic valve.

11. A fuel injection apparatus as defined by claim 5, in which said control valve (37) is embodied as an electrically triggered electromagnetic valve.

12. A fuel injection apparatus as defined by claim 6, in which said control valve (37) is embodied as an electrically triggered electromagnetic valve.

13. A fuel injection apparatus as defined by claim 1, in which one pressure dependent fuel tapping device (45) per cylinder of said internal combustion engine is provided which are individually controllable and consequently forms one closed injection quantity control circuit for each cylinder that is regulatable according to an exhaust gas temperature or an exhaust gas emissions.

14. A fuel injection apparatus as defined by claim 2, in which one pressure dependent fuel tapping device (45) per cylinder of said internal combustion engine is provided which are individually controllable and consequently forms one closed injection quantity control circuit for each cylinder that is regulatable according to an exhaust gas temperature or an exhaust gas emissions.

15. A fuel injection apparatus as defined by claim 3, in which one pressure dependent fuel tapping device (45) per cylinder of said internal combustion engine is provided which are individually controllable and consequently forms one closed injection quantity control circuit for each cylinder that is regulatable according to an exhaust gas temperature or an exhaust gas emissions.

16. A fuel injection apparatus as defined by claim 4, in which one pressure dependent fuel tapping device (45) per cylinder of said internal combustion engine is provided which are individually controllable and consequently forms one closed injection quantity control circuit for each cylinder that is regulatable according to an exhaust gas temperature or an exhaust gas emissions.

17. A fuel injection apparatus as defined by claim 5, in which one pressure dependent fuel tapping device (45) per cylinder of said internal combustion engine is provided which are individually controllable and consequently forms one closed injection quantity control circuit for each cylinder that is regulatable according to an exhaust gas temperature or an exhaust gas emissions.

18. A fuel injection apparatus as defined by claim 6, in which one pressure dependent fuel tapping device (45) per cylinder of said internal combustion engine is provided which are individually controllable and consequently forms one closed injection quantity control circuit for each cylinder that is regulatable according to an exhaust gas temperature or an exhaust gas emissions.

19. A fuel injection apparatus as defined by claim 7, in which one pressure dependent fuel tapping device (45) per cylinder of said internal combustion engine is provided which are individually controllable and consequently forms one closed injection quantity control circuit for each cylinder that is regulatable according to an exhaust gas temperature or an exhaust gas emissions.

* * * * *